US007701362B2

(12) United States Patent
Philiben

(10) Patent No.: US 7,701,362 B2
(45) Date of Patent: Apr. 20, 2010

(54) OPTICAL SYSTEM FOR DETECTING AN OBJECT

(75) Inventor: Scott Philiben, Bend, OR (US)

(73) Assignee: Precise Flight, Inc., Bend, OR (US)

( * ) Notice: Subject to any disclaimer, the term of this patent is extended or adjusted under 35 U.S.C. 154(b) by 493 days.

(21) Appl. No.: 11/707,669

(22) Filed: Feb. 16, 2007

(65) Prior Publication Data

US 2008/0198039 A1 Aug. 21, 2008

(51) Int. Cl.
*G08G 5/04* (2006.01)

(52) U.S. Cl. ..... 340/961; 340/981; 362/84; 362/540

(58) Field of Classification Search ..... 340/961, 340/981; 362/84, 470, 510, 511, 540
See application file for complete search history.

(56) References Cited

U.S. PATENT DOCUMENTS

| | | | | |
|---|---|---|---|---|
| 531,653 | A | 1/1895 | Selden | |
| 2,960,679 | A | 11/1960 | Atkins | |
| 3,203,305 | A | 8/1965 | Fairbanks | |
| 3,572,928 | A | 3/1971 | Decker, Jr. | |
| 3,620,626 | A | 11/1971 | Daly | |
| 3,641,491 | A | 2/1972 | Bath | |
| 3,652,981 | A | 3/1972 | Campanella | |
| 3,706,968 | A | 12/1972 | Turner, Jr. | |
| 3,846,746 | A | 11/1974 | Trageser | |
| 3,903,501 | A | 9/1975 | Greenlee et al. | |
| 4,139,848 | A | 2/1979 | Maxwell, Jr. | |
| 4,256,366 | A | 3/1981 | Buckelew | |
| 4,277,170 | A | 7/1981 | Miles | |
| 4,527,158 | A * | 7/1985 | Runnels | 340/961 |
| 4,736,907 | A | 4/1988 | Steffen | |
| 4,755,818 | A | 7/1988 | Conrad | |
| 4,918,442 | A | 4/1990 | Bogart | |
| 5,057,820 | A | 10/1991 | Markson | |
| 5,057,833 | A * | 10/1991 | Carlson | 340/961 |
| 5,206,644 | A | 4/1993 | Dempsey | |
| 5,270,707 | A | 12/1993 | Schulte et al. | |
| 5,291,196 | A | 3/1994 | Defour | |
| 5,293,304 | A * | 3/1994 | Godfrey | 362/464 |
| 5,317,316 | A | 5/1994 | Sturm et al. | |
| 5,319,367 | A | 6/1994 | Schulte et al. | |
| 5,321,489 | A | 6/1994 | Defour | |
| 5,334,982 | A | 8/1994 | Owen | |
| 5,506,590 | A | 4/1996 | Minter | |
| 5,515,026 | A | 5/1996 | Ewert | |
| 5,774,088 | A | 6/1998 | Kreithen | |
| 5,777,563 | A | 7/1998 | Minissale et al. | |
| 5,914,651 | A | 6/1999 | Smalls | |
| 5,933,099 | A | 8/1999 | Mahon | |
| 5,939,987 | A | 8/1999 | Cram | |
| 5,983,161 | A | 11/1999 | Lemelson et al. | |
| 6,155,694 | A | 12/2000 | Lyons et al. | |
| 6,250,255 | B1 | 6/2001 | Lenhardt et al. | |
| 6,252,525 | B1 | 6/2001 | Philiben | |
| 6,456,205 | B1 * | 9/2002 | Russell et al. | 340/815.45 |
| 6,502,035 | B2 | 12/2002 | Levine | |
| 6,940,424 | B2 | 9/2005 | Philiben et al. | |

FOREIGN PATENT DOCUMENTS

| | | |
|---|---|---|
| DE | 19858204 | 6/2000 |

* cited by examiner

*Primary Examiner*—Toan N Pham
(74) *Attorney, Agent, or Firm*—Chernoff, Vilhauer, McClung & Stenzel, LLP

(57) ABSTRACT

A system for optically detecting an object comprises a light source associated with the object and operated to produce a temporal pattern of emissions and a detector, synchronized to the operation of the light source by signals from a global positioning system, to identify light emissions according to the temporal pattern.

26 Claims, 5 Drawing Sheets

150
START
152
DETERMINE TIME
153
DETERMINE LOCATION
154
LOCATION CHANGED?
156
no
yes
178
RESET TIMER
DETERMINE PATTERN
158
DETERMINE NEXT START
160
SYNCHRONIZE START TIMER
162
152
DECREMENT START TIMER
164
t=0?
no
yes
168
ENERGIZE SOURCE
START ILLUMINATION TIMER
170
172
DECREMENT ILLUMINATION TIMER
174
t=0?
no
yes
176
DEENERGIZE SOURCE

OPTICAL SYSTEM FOR DETECTING AN OBJECT

CROSS-REFERENCE TO RELATED APPLICATIONS

Not applicable.

BACKGROUND OF THE INVENTION

The present invention relates to a system for optically detecting the presence of an object.

Human vision is the primary sensory agency through which a vehicle is navigated and through which collisions with other vehicles and objects are avoided. Vision is relied on to detect both stationary and moving objects in sufficient time to enable navigational decisions and to permit effective evasive action. To aid visual detection, many vehicles, structures and other objects are painted, marked or equipped with lighting systems intended to increase the conspicuousness of the object and the likelihood that the object will be observed.

Vehicles, including aircraft, emergency vehicles and slow moving vehicles; structures, such as tall buildings, communication towers and power lines; and other objects, such as runways and highway and other hazard warning signage, are commonly equipped with lighting systems that are intended to draw the attention of potential observers. These lighting systems typically comprise variable intensity or flashing lights which are commonly accepted to be superior to steady-state illumination for attracting human attention. For example, Federal Aviation Administration (FAA) regulations require that aircraft be equipped with an anti-collision lighting system comprising sufficient numbers of flashing lights arranged to illuminate the vital areas around the airplane, considering its physical configuration and flight characteristics, and covering a field extending 75 degrees above and below the horizontal plane of the aircraft. In addition to the anti-collision lighting system, aircraft are equipped with external recognition lights, including a position light system comprising red and green forward lights to distinguish the right and left sides of the plane and a rear mounted white light. Similarly, emergency vehicles and slow moving vehicles are commonly equipped with one or more flashing lights intended to make the vehicle more conspicuous to potential observers, including operators of other vehicles.

However, psychological factors, such as inattentiveness and fatigue; physiological limitations of human vision; atmospheric conditions and visual obstructions commonly prevent observation of objects of interest, including objects that might threaten collision or be important to navigation even if they are equipped with attention attracting lights. For example, more than 80% of mid-air collisions involve a first aircraft overtaking a second aircraft at a converging angle. Any one of many factors, including psychological and physiological factors, may explain the failure of a pilot of an overtaking aircraft to observe flashing lights of the anti-collision system of an aircraft being overtaken. On the other hand, even if the pilot's attention were focused to the rear, in all likelihood, the structure of the aircraft that is being overtaken would block the pilot's view of the overtaking aircraft.

Campanella, U.S. Pat. No. 3,652,981, discloses a proximity warning system based on the detection of the illumination of an exterior flash lamp or strobe mounted on a first aircraft by one or more electro-optical sensors in a second aircraft. The output of the electro-optical sensor is displayed in the cockpit to warn of nearby traffic and an audible alarm may emit an aural tone to draw the pilot's attention to the display.

The system detects the presence of one or more sources of light emissions and provides an indication of the relative positions of the detected light source and the detector. However, generally, the system does not distinguish between light sources. Many objects of interest, such as airplanes, include multiple light sources. Including combinations of steady-state and flashing lights, and the environment, such as the vicinity of an urban airport or a crowded highway, may include large numbers of sources of light emissions, only a few of which may be of interest. Distinguishing between sources of illumination aids in rapid identification of sources of interest and enables more timely decision making concerning the significance of the source to the potential human observer. Campanella does disclose an embodiment of the proximity warning system in which a weather radar of one airplane is used to initiate flashing of a light in a second plane. The appearance of a new source of light may aid in distinguishing the flashing light associated with the second airplane from other light emitters in the vicinity. However, weather radar is typically only focused forward and many vehicles, including many aircraft, are not equipped with radar.

What is desired, therefore, is an optically-based system for detecting the presence of objects that are likely to be of interest to a human observer.

DETAILED DESCRIPTION OF PREFERRED EMBODIMENTS

Figure 1:
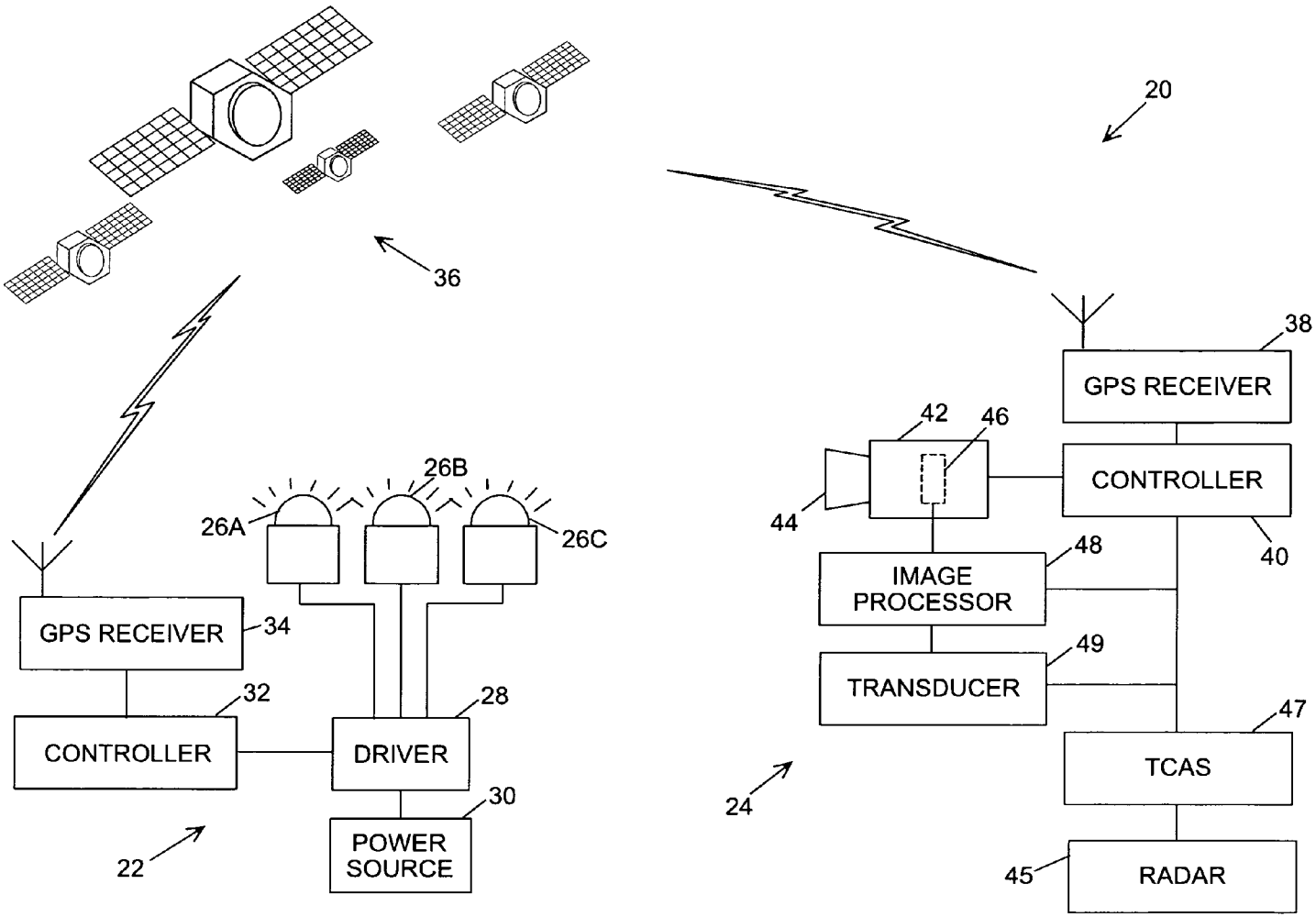
FIG. 1 is a block diagram of an optical system for detecting objects.

Vehicle operators are believed to rely almost exclusively on vision for the sensory inputs used in navigation and collision avoidance. As a result, many vehicles, structures and other objects include markings and lighting that are intended to make the object more conspicuous and increase the likelihood that the object will be noticed by potential human observers, including the operators of other vehicles. Flashing lights are commonly accepted as superior to steady state signals in attracting human attention and are commonly used as visual warning devices. For example, Federal Aviation Administration (FAA) regulations require that aircraft be equipped with an anti-collision lighting system comprising sufficient numbers of flashing lights arranged to illuminate the vital areas around the airplane, considering its physical configuration and flight characteristics, and covering a field extending 75 degrees above and below the horizontal plane of the aircraft. However, even when equipped with lighting systems intended to attract the attention of potential human observers, objects of interest, including objects that might threaten collision or be significant to navigation, are often not observed. Psychological factors, such as distraction, inattentiveness and fatigue; physiological limitations of human vision; atmospheric conditions and visual obstructions commonly contribute to failures of humans to observe hazards even if marked with warning lights. For example, more than 80% of mid-air collisions involve a first aircraft overtaking a second aircraft at a converging angle and any one of many psychological, physiological and other factors may explain the failure of a pilot of an overtaking aircraft to observe the anti-collision lights of the aircraft that is being overtaken. On the other hand, the attention of the pilot of the aircraft that is being overtaken is in all likelihood focused forward and the structure of his/her aircraft would, in all likelihood, block the view of an airplane overtaking from the rear. The inventors concluded that a system that enables detection of the lights of warning, navigation or other lighting system could increase the likelihood and timeliness of the detection of the associated object.

However, objects, such as airplanes, ambulances or highway warning signage, are often equipped with a plurality of light sources, including both flashing and steady-state lights, and, in many instances, there are a number of light sources that are located in the vicinity but unrelated to the object of potential interest. For example, in addition to the lighting of the anti-collision system, aircraft are equipped with external recognition lights, including forward mounted, colored, position lights and a rear mounted white light to aid other pilots in determining the direction of flight of the plane. Emergency vehicles and slow moving vehicles are commonly equipped with one or more flashing lights intended to make the vehicle more conspicuous to potential observers, including operators of other vehicles, and, depending on conditions, the vehicle's headlights, brake lights and turn signals may also be illuminated. Stationary objects, such as buildings, power and communication towers, power lines and runways, are also commonly equipped with a combination of flashing sources of illumination intended to attract the attention of potential observers and steady state sources for other purposes. The inventors further concluded that the effectiveness of an optical system of object detection would be enhanced if, in addition to enabling detection of sources of light emissions, the system could distinguish between a light source associated with an object of potential interest and other sources of emissions. For example, the effectiveness of an optical detection system would be enhanced and the likelihood of false alarms reduced by distinguishing between a flashing warning light on a emergency vehicle and its the turn signals or headlights or the turn signals and headlights of other vehicles on the highway. The inventors concluded that objects of interest could be detected with more timeliness and accuracy if light sources associated with those objects were illuminated in a temporal pattern that could be distinguished by a detector from the detected light emissions of other sources.

Referring in detail to the drawings where similar parts are identified by like reference numerals, and, more particularly to FIG. 1, the system 20 for optically detecting an object comprises a controlled source of light emissions 22, including one or more lights or lamps 26A, 26B, 26C, typically attached to or otherwise geographically associated with an object of potential interest, such as an airplane, an emergency vehicle, a person, a structure or hazard signage; and a detector 24 that is arranged to detect and distinguish light emissions from a controlled source and which is, typically, associated with a potential human observer, for example, the operator of another vehicle.

The light source may comprise a lamp 26A that is periodically energized to produce a pattern of light flashes. On the other hand, the light source may comprise a lamp that is connectible to a source of varying voltage to produce a pattern of light emissions of varying intensities including emissions at intensities intermediate between the minimum and maximum output of the lamp. Moreover, the light source may comprise a plurality of lamps 26A, 26B, 26C, each emitting light in a narrow band of wavelengths. By temporally varying the intensity of emissions from individual lamps, the spectral makeup of the light emitted by the light source can be varied in a distinctive pattern. The light source may emit light of one or more wavelengths visible to humans and/or it may emit light comprising wavelengths not visible to humans. For example, an infrared light source may be part of a friend or foe recognition system where it is desirable to reduce the likelihood that the emissions will be detected by some potential observers.

The pattern of emissions is determined by a controller 32 that receives data from a global positioning system (GPS) receiver 34 that may be co-located with the light source or may be remotely located if the relative geographic positions of the light source and the receiver are known. The controller outputs signals to enable the desired pattern of illumination, for example, by controlling the time of initiation of illumination, the identity of lamp(s) illuminated, the intensity of illumination, and the length of a period of illumination. A driver 28 selectively interconnects the lamp(s) and a power source 30 in response to signals from the controller to produce the desired temporal pattern of illumination. While the driver may be of a type that connects and disconnects the lamp and the power source to produce flashes of light, the driver 28 be of a type that enables selective interconnection of the ones of a plurality of lamps or variation of the voltage supplied to one or more lamps to produce temporal patterns of emissions of variable spectrum or intensity.

The global positioning system (GPS) comprises a constellation of, at least, 24 satellites 36 orbiting the earth every twelve hours in circular orbits, a plurality of ground-based monitoring stations, a control station and a GPS receiver 34, 38. Four of the satellites orbit in each of six orbital planes with the orbits aligned so that at least four satellites are continuously within line of sight of any place on Earth. The GPS satellites broadcast navigation signals comprising a 37,500 bit navigation message including an almanac, providing coarse time and status information, and an ephemeris comprising orbital information that enables the receiver to calculate the position of the satellite. In addition, the satellites broadcast clock information comprising a code acquisition code and a phase code (P code). The code acquisition code comprises a unique, 1,023 bit, pseudo-random code that enables identification of the broadcasting satellite. It is broadcast at 1.023 MHz and repeats every millisecond. The P-code is a similar code but it is broadcast at 10.23 MHz and repeats weekly. The navigation message and the clock information are mixed together and transmitted over a primary radio channel at 1575.42 MHz.

A GPS receiver determines its geographic position by calculating its distance from each of the GPS satellites within line of sight of the receiver. The distance is calculated by measuring the time delay between transmission of the code acquisition signal by a satellite and receipt of the signal by the receiver. When the receiver receives the signal from a satellite, the satellite is identified from the unique pattern of the code acquisition sequence. The receiver calculates the time delay for the transmission from the satellite by producing a code sequence identical to the code acquisition sequence received from the satellite and by comparing the locally produced sequence to the sequence received from the satellite as a delay in comparing the sequences is increased. When the two signals match, the delay experienced by the local sequence is equal to the time that is required for the transmitted sequence to reach the receiver. From the delay, typically 65-85 milliseconds, and the data in the ephemeris, a pseudorange, the distance between the receiver and the satellite, is calculated. By determining the simultaneous position of four satellites and their respective distances from the receiver, the geographic location of the receiver can be determined.

Accurate time signals enable the GPS receiver to determine its location. A master control station gathers data from each satellite in the constellation and updates time and frequency error, frequency drift and orbital parameters for each satellite and its atomic clock enabling GPS time consistency throughout the constellation of a few nanoseconds and determination of the satellite's position within a few meters. A crystal oscillator-based clock in the receiver is continuously reset from the time data transmitted from the satellites enabling its synchronization with the atomic clocks in the satellites and a time accuracy nearly equaling the accuracy of the atomic clocks. The GPS system utilizes GPS time, a continuous time measured in weeks and seconds from the GPS zero time of midnight, Jan. 5, 1980. GPS time is not adjusted for the earth's rotation and, therefore, is not corrected for leap seconds. However, GPS time can be corrected for Coordinated Universal Time (UTC) by adjusting to account for the current discrepancy represented by the number of leap seconds that have accumulated from the zero time. Operation of the light source subsystems 22 and the light detector subsystems 24 of the object detection system 20 can be synchronized with either GPS or UTC time.

The detector subsystem 24, which is, typically, associated with a potential observer of an object of interest, also comprises a GPS receiver 38. The GPS receiver inputs time data from the GPS system to a detector controller 40 which uses the time data to distinguish controlled sources of illumination in images captured by an optical sensor 42, such as a digital camera. The optical sensor preferably includes an image sensor 46, such as a charge coupled device (CCD) comprising a two-dimensional array of photo-sensitive elements or photo-sites, and a lens 44 to focus light on the image sensor. Light striking a photo-site on the image sensor produces an electrical charge having a magnitude related to the intensity of light impinging on the photo-site. An image processor 48 distinguishes point sources of light emissions appearing within an image captured by the image sensor and determines the relative position of the emissions of the source(s) from the locations of the effected photo-sites in the array of photo-sites. The detector subsystem controller 40 controls the operation of the optical sensor and regulates the capture of images. The time interval for capturing images is preferably a portion of the illumination cycle for proximately located, controlled light sources so that images will be captured at times when the lamps of the light sources are not illuminated or illumination is minimized and at times when the controlled light sources are illuminated. Images may be captured at a predetermined rate or at a rate determined by the controller from, for example, the geographic position of the detector.

Figure 2:
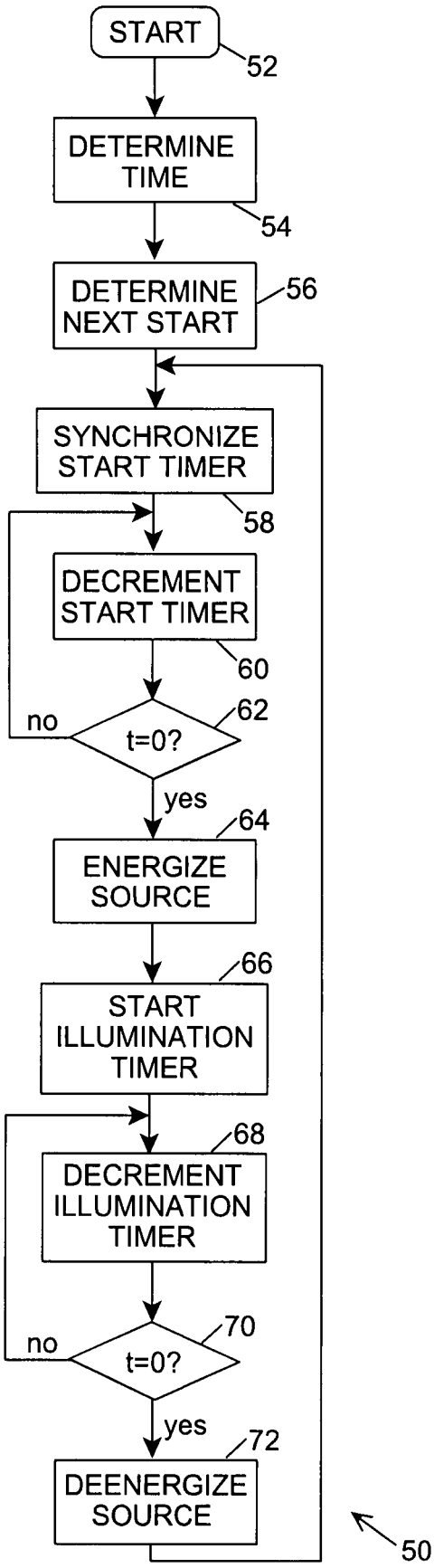
FIG. 2 is a flow diagram for a method of operating a controlled light source.

Referring to FIG. 2, the light source controller 32 utilizes time data provided by the GPS receiver 34 to control operation 50 of a controlled light source. When the light subsystem 22 is activated 52, the GPS receiver associated with the light source determines the time 54 and calculates the start time for the next period of synchronized illumination 56. A start timer is synchronized 58 utilizing the time signals, for example GPS or UTC time, of the GPS system and decremented 60. When the start timer reaches zero, the light source, one or more lamps 26, is energized 64 by the driver 28 in response to signals from the controller, as required by the pattern of illumination, and an illumination timer is started 66 to time the duration of the period of illumination. The illumination cycle may comprise a fixed interval of non-illumination or minimum intensity and a variable interval of illumination or maximum intensity; a variable interval of minimum intensity and a fixed interval of maximum intensity; or a variable interval of minimum intensity and a variable interval of maximum intensity. Likewise, the illumination cycle may comprise intervals of varying intensity of each of plurality wavelengths emitted by the ones of a plurality of lamps. The illumination timer is decremented 68 until the illumination interval times out 70. When the illumination interval expires, the lamp is de-energized 72 or the interconnection of the lamp and the power source is otherwise modified as appropriate for the pattern of illumination and the start timer is re-synchronized and restarted to time the interval to the initiation of the next period of illumination. The accuracy of the GPS time signals enable accurate timing of the initiation and duration of periods of illumination.

Figure 3:
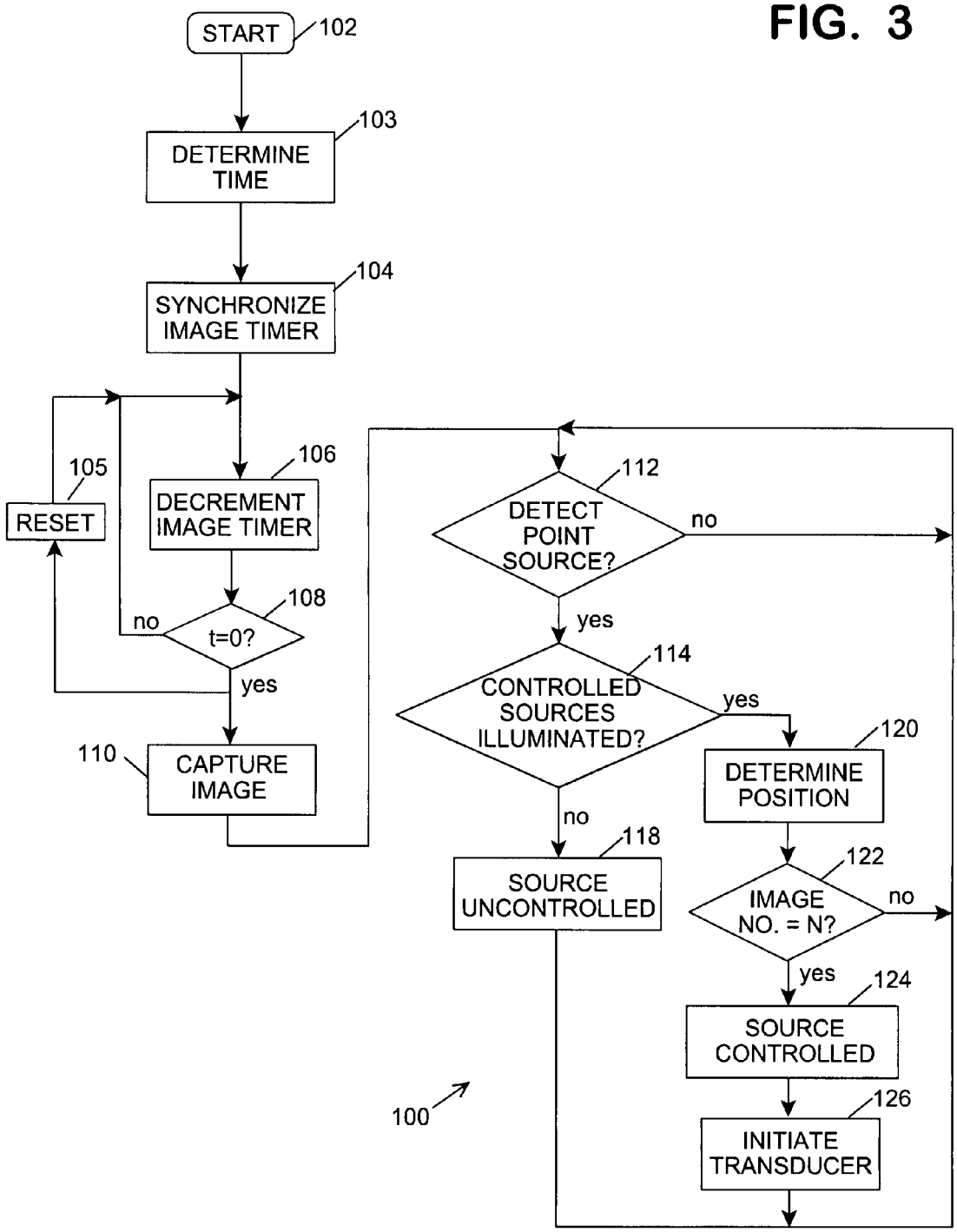
FIG. 3 is a flow diagram for a method of operating a synchronized detector of controlled light sources.

Referring to FIG. 3, the time signals of the GPS system enable the operation 100 of the detector subsystem to be synchronized with the operation of the controlled source of light emissions. When operation of the detector is initiated 102, the detector controller determines the time from the GPS receiver 103 and synchronizes an image capture timer 104 in the controller 40 to capture images in synchronization with periods of illumination and non-illumination of proximately located, controlled light sources. After synchronization, the image capture timer is decremented 106. When the timer expires 108, an image is captured 110 by the image capture device 42 and the image capture timer is reset 105 and begins timing the interval to the next image capture. The image processor 48 scans the output of the image sensor 46 to determine if the captured image contains point sources of illumination 112. If no point sources of light are found in the captured image, the controller awaits the capture of the next image.

If the image processor detects one or more point sources of illumination in the captured image 114 and if the image capture occurred when proximately located, controlled light sources were not illuminated, the source of light detected in the image is designated as an uncontrolled light source 118, such as a steady state source or a randomly flashing source. On the other hand, if the image was captured during a period of illumination of controlled light sources, the point sources of light detected in the image by the image processor are designated as potential controlled sources associated with an object of interest. The relative position of the detected light source is determined 120, for example by identifying the locations of effected photo-sites in the two-dimensional array of the image sensor, and stored by the controller. Additional assurance that a detected source is actually a controlled light source associated with an object of potential interest can be provided by the detection of the light source in a plurality of images captured during a plurality of periods of illumination of controlled light sources and by the failure to detect of the light source in images captured during times of non-illumination of controlled light sources. When he same source of light has been, appropriately, detected or not detected in a predetermined number of images 122 captured during respective periods of illumination and non-illumination of controlled light sources, the source is designated as a controlled light source 124 and a transducer 49 is activated 126 to advise the potential observer, for example, the operator of a vehicle, of the presence of the detected objects of interest. The transducer 49 may output audible and/or visual presentations indicating the detection and location of a proximate object of interest. In addition, the controller may combine the output of the object detection system and the outputs of other detection systems, such as radar 45 and the Traffic Collision Avoidance System (TCAS) 47 in a single visual and/or audible display.

In another embodiment of the object detection system, the controller causes the driver to interconnect one or more lamps 26 to the power source to produce a pattern or cycle of illumination that is determined by the geographic location of the light. The illumination cycle may comprise a fixed interval of non-illumination or minimum intensity and a variable interval of illumination or maximum intensity; a variable interval of minimum intensity and a fixed interval of maximum intensity; or a variable interval of minimum intensity and a variable interval of maximum intensity with the lengths of the intervals being determined by the geographic position of the light source and, optionally, the classification of the object with which the light is associated, by way of examples, an aircraft or a stationary object. Likewise, the illumination cycle may comprise intervals of varying intensity of each of plurality wavelengths emitted by the ones of a plurality of lamps. The controller may look up an illumination pattern or cycle in a database relating illumination patterns or cycles to respective geographic coordinates or may calculate the illumination pattern from a relationship expressing the illumination pattern as a function of geographic coordinates, object classification and/or time.

Figure 4:
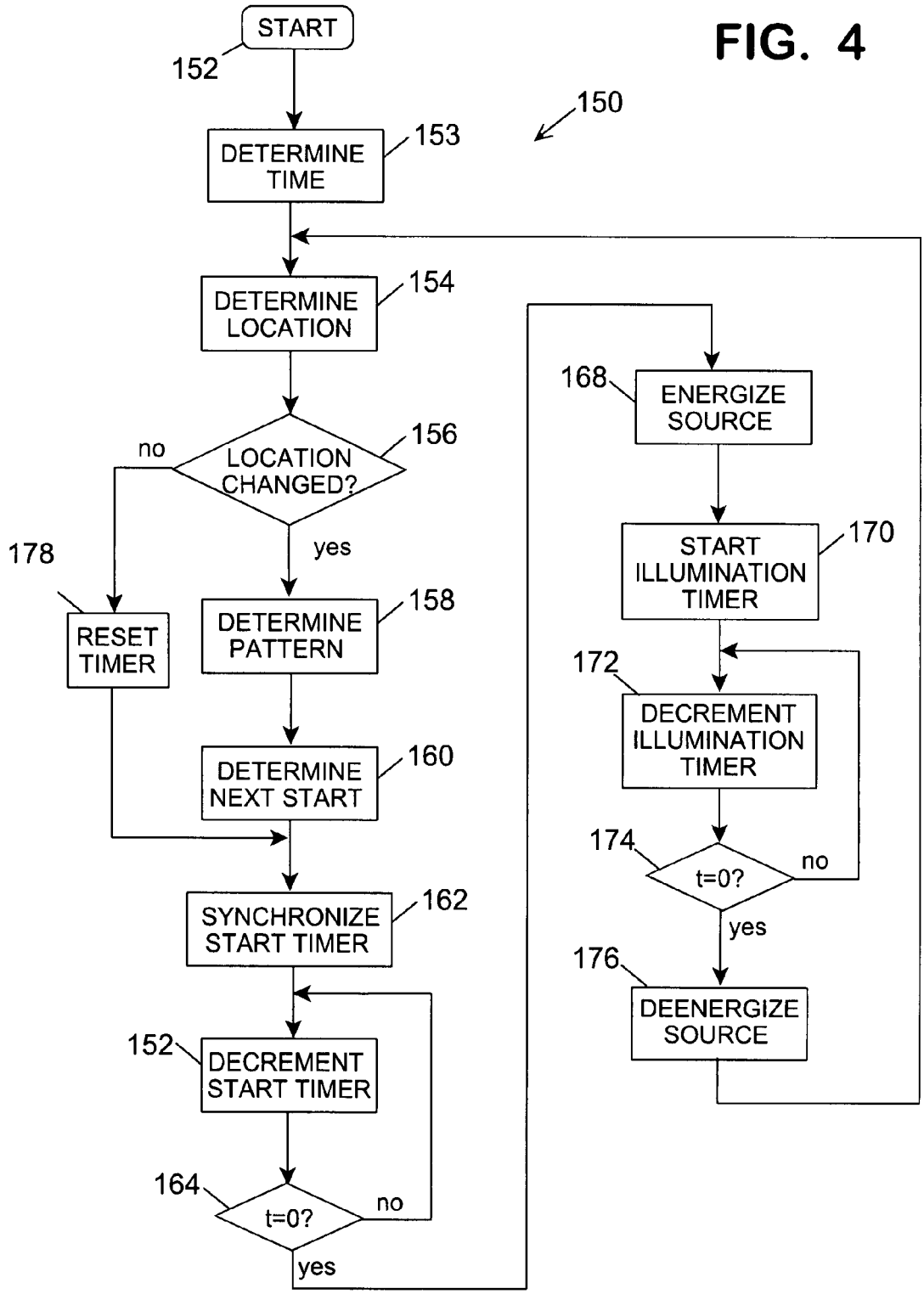
FIG. 4 is a flow diagram for method of operating a position controlled light source.

Referring to FIG. 4, in another embodiment of the object detection system, the operation of the light subsystem 150 produces a temporal pattern of illumination that is distinctive for the geographic location of the light, the nature of the associated object and/or the time. When the controlled light source 22 is activated 152, the GPS receiver associated with the light source determines the determines the time 153 and the location of the light 154. Since there is no prior location of the light at start up 156, the controller determines the illumination pattern applicable to the current location 158. The interval to initiation of the illumination pattern is determined from the GPS time data 160 and a start timer is synchronized 162. The start timer is decremented 152 until the interval to initiation has elapsed 164. When the time interval to the initiation of illumination has elapsed, the controller signals the driver to interconnect the power source and the lamp(s) initiating a period of illumination 168 and starts an illumination timer to time the illumination interval 170. The illumination timer is decremented 172 for the interval of illumination 174 and then the controller signals the driver to vary the interconnection of the source and the lamp to deenergize or otherwise vary the emissions of the light source 176.

The controller determines if the geographic position of the light has changed 156 since the previous illumination cycle. If the location has changed, a new illumination interval is determined based on the geographic position of the light and the start and illumination timers are set for the new illumination cycle. If the location of the object associated with the light source is unchanged, the length of the interval of illumination and the interval to the initiation of the next period of illumination remain the same and the timers are reset to produce the same temporal pattern of emissions 178. A position controlled light source associated with a stationary object of interest such a transmission tower or runway requires only time data once the position has been established because the location does not change. The interval to the initiation of the next period of illumination is determined and the start timer is synchronized 162 and decremented to time initiation of the next period of illumination.

Figure 5:
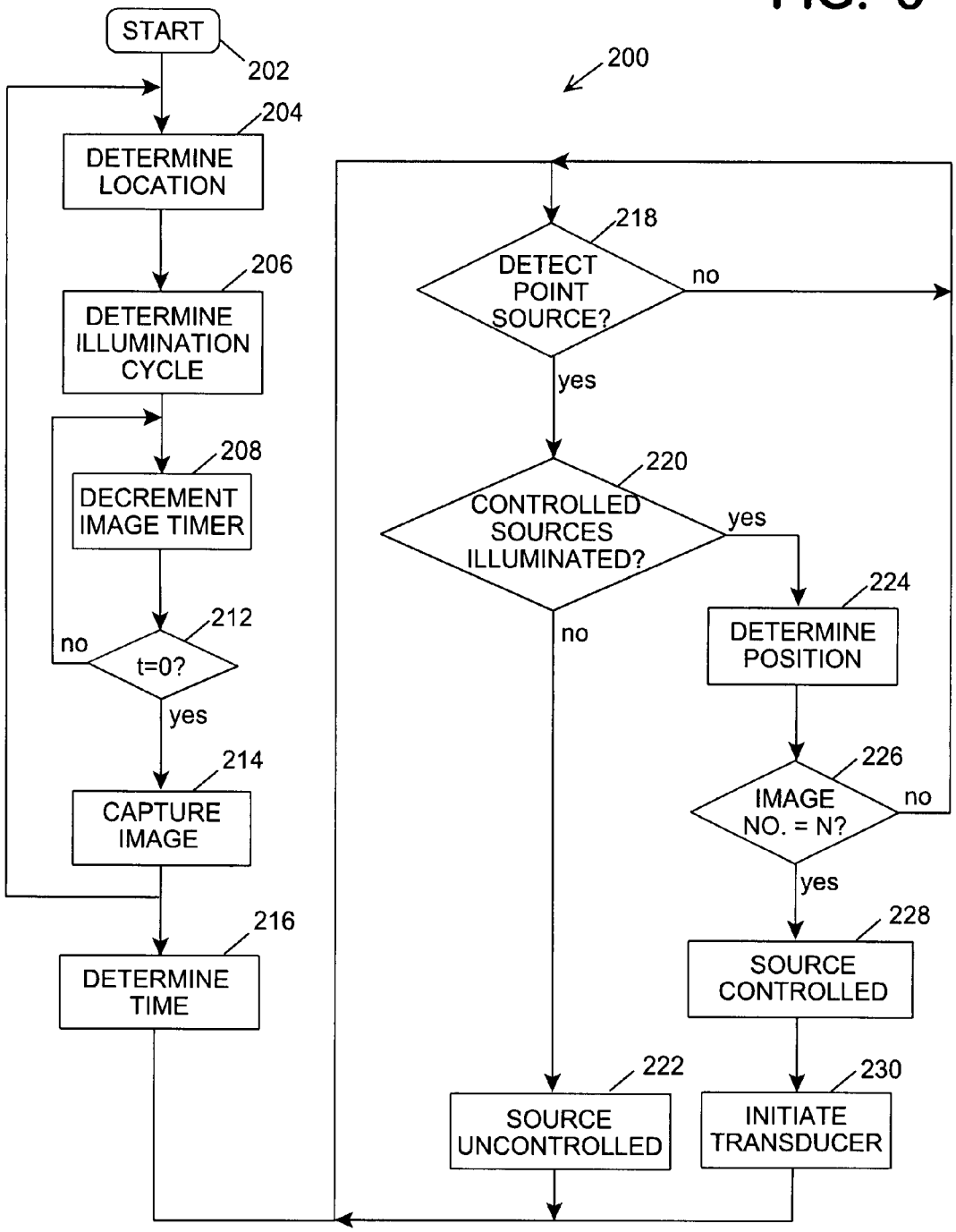
FIG. 5 is a flow diagram for a method of detecting a position controlled light source.

Referring to FIG. 5, detection of location controlled light sources is provided with another embodiment of the method of detector subsystem operation 200. When operation of the detector subsystem is initiated 202, the detector controller activates the GPS receiver to determine the geographic position of the detector 206. From at least one of the geographic position of the detector and a classification of an object of potential interest and, typically, a table relating the location and/or classification to a temporal pattern of illumination, the controller determines the temporal pattern of illumination 208 for proximately located, controlled light sources. An image capture timer is initialized and decremented 208. When the image capture timer times out 212, the image capture device 42 is signaled to capture an image 214 and the time of image capture is determined from a GPS time signal from the GPS receiver 216. The controller determines if the location of the detector has changed 204 and, consequently, if the temporal illumination pattern of controlled sources has changed 206, in preparation for the next image capture.

The image processor 48 scans the output of the image sensor 46 to determine if the captured image contains point sources of illumination 218. If no point sources of light emissions are found in the captured image, the image processor awaits the next image capture.

If the image processor detects point sources of illumination in the captured image 218, the controller determines if the image capture occurred during a period of illumination of proximately located, controlled light sources 220. If the image capture occurred when proximately located controlled light sources were not illuminated, the source of light detected in the image is designated as an uncontrolled light source 222, such as a steady state source or a randomly flashing source and the image processor awaits the capture of the next image.

On the other hand, if the image was captured during a period of illumination of proximately located controlled light sources 220, the point sources of light detected in the image by the image processor are designated as potential controlled sources associated with an object of interest and the position of the detected source relative to the detector is determined 224. A source of light can be identified as a controlled source if the emissions are detected in a plurality of images captured during periods of illumination of proximately located, controlled light sources and if the source of light does not appear in a plurality of images captured during intervals of non-illumination of controlled sources. When the system has detected or failed to detect a source of light in a predetermined number of images captured during respective periods of illumination and non-illumination 226, the source is designated as a controlled light source 228 or a controlled light source associated with a particular type of object and a transducer 49 is activated 230 to advise the potential observer of the presence of the detected objects.

The system for optically detecting an object of interest comprises a light source illuminated in a temporal pattern which may be determined by the geographic position of the source or the classification of the associated object and a detector arranged to detect the light emissions and distinguish the temporal pattern of emissions from controlled sources from other patterns of illumination.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

I claim:

1. A system for detecting an object comprising:

(a) a source of light geographically associated with the object and operable to emit light in a temporally distinct pattern of illumination, said temporally distinct pattern of illumination is distinctive of a location of said object; and (b) a detector operable to capture light emission and to determine said location of said object encoded in said temporal pattern of illumination.

2. The system for detecting an object of claim 1 wherein:

(a) said temporally distinct pattern of illumination is further distinctive of an identity of said object associated with said source of light; and (b) said detector is operable to determine from said temporally distinct pattern of illumination said identity of said object.

3. The system for detecting an object of claim 1 wherein said detector operable to capture light emission and distinguish a source emitting light in said temporally distinct pattern of illumination comprises:

(a) an optical sensor arranged to capture impinging light at an image capture time;

(b) an image processor to distinguish a point source of light in said captured light; and (c) a detector controller to determine if said image capture time coincides with a time of illumination of a light source operated to emit light in said temporally distinct pattern of illumination.

4. The system for detecting an object of claim 3 wherein said detector controller determines said image capture time from a signal from a global positioning system.

5. The system for detecting an object of claim 1 wherein said source of light operable to emit light in a temporally distinct pattern of illumination comprises:

(a) a power source;

(b) a lamp arranged to emit light when interconnected to said power source;

(c) a driver operable to selectively vary an interconnection of said lamp and said power source; and (d) a controller to cause said driver to vary said interconnection of said power source and said lamp at a first time and a second time, at least one of said first time and said second time being determined by a signal emitted by a global positioning system.

6. The system for detecting an object of claim 5 wherein said signal emitted by said global positioning system is a time signal.

7. The system for detecting an object of claim 5 wherein said detector operable to capture light emission and distinguish a source emitting light in said temporally distinct pattern of illumination comprises:

(a) an optical sensor arranged to capture impinging light at an image capture time;

(b) an image processor to distinguish a point source of light in said captured light; and (c) a detector controller to determine if said image capture time coincides with a time of illumination of a light source operated to emit light in said temporally distinct pattern of illumination.

8. The system for detecting an object of claim 7 wherein said detector controller said image capture time from a signal from a global positioning system.

9. The system for detecting an object of claim 1 wherein said source of light operable to emit light in a temporally distinct pattern of illumination comprises:

(a) a power source;

(b) a lamp arranged to emit light when interconnected to said power source;

(c) a driver operable to selectively vary an interconnection of said lamp and said power source; and (d) a controller to cause said driver to vary said interconnection of said power source and said lamp at a first time and a second time, at least one of said first time and said second time being determined by a geographic position of said lamp.

10. The system for detecting an object of claim 9 wherein said controller determines said geographic position of said lamp from a signal emitted by a global positioning system.

11. The system for detecting an object of claim 9 wherein said detector operable to capture light emission and distinguish a source emitting light in said temporally distinct pattern of illumination comprises:

(a) an optical sensor arranged to capture impinging light at an image capture time;

(b) an image processor to distinguish a point source of light in said captured light; and (c) a detector controller to determine if said image capture time coincides with a time of illumination of a lamp connected to a power source at a connection time and disconnected from said power source at a disconnection time, at least one of said connection time and said disconnection time being determined by a geographic position of said optical sensor.

12. The system for detecting an object of claim 11 wherein said detector controller said image capture time from a signal from a global positioning system.

13. A light source operable to produce a temporally distinct pattern of light emissions of, said light comprising:

(a) a power source;

(b) a lamp arranged to emit light when interconnected to said power source;

(c) a driver operable to selectively vary an interconnection of said lamp and said power source; and (d) a controller to cause said driver to vary said interconnection of said power source and said lamp at a first time and a second time, at least one of said first time and said second time being determined by a signal emitted by a global positioning system.

14. The light source of claim 13 wherein said signal emitted by said global positioning system comprises a time signal.

15. The light source of claim 13 wherein said signal emitted by said global positioning system comprises a geographic position signal.

16. The light source of claim 13 wherein said driver operable to vary an interconnection of said lamp and said power source is operable to cause said lamp to emit light of a first intensity at said first time and to emit light of second intensity at said second time.

17. The light source of claim 13 wherein said driver operable to vary an interconnection of said lamp and said power source is operable to cause said lamp to emit light of a first wavelength at said first time and to emit light of second wavelength at said second time.

18. The light source of claim 13 wherein light emitted by said lamp when interconnected to said power source comprises a wavelength not visible to a human.

19. A method for detecting an object comprising the steps of:

(a) geographically associating with said object a light source arranged to emit light in a temporally distinct pattern of emission, said temporally distinct pattern of emission is pattern distinctive of a geographical location of said light source;

(b) capturing light impinging on a detector at an image capture time; and (c) determining if a detected light emission included in said captured light was emitted in said temporally distinct pattern indicative of said location of said light source.

20. The method for detecting an object of claim 19 wherein said temporally distinct pattern of emission comprises:

(a) a first emission of light at a first intensity at a first time; and (b) a second emission of light at a second intensity at a second time.

21. The method for detecting an object of claim 19 wherein said temporally distinct pattern of emission comprises:

(a) a first emission of light at a first wavelength at a first time; and (b) a second emission of light at a second wavelength at a second time.

22. The method for detecting an object of claim 21 wherein light of at least one of said first wavelength and said second wavelength is not detectable by human vision.

23. The method for detecting an object of claim 19 wherein the step of determining if said captured light was emitted in said temporally distinct pattern of emission comprises the steps of:

(a) distinguishing said detected light emission in said captured light; and (b) determining if said image capture time coincides with a time of emission by said light source arranged to emit light in said temporally distinct pattern of emission.

24. The method for detecting an object of claim 23 wherein the step of determining if said image capture time coincides with a time of emission by said light source arranged to emit light in said temporally distinct pattern of emission comprises the steps of:

(a) determining a time of emission by said light source from a signal emitted by a global positioning system;

(b) determining said image capture time from said signal emitted said global position system; and (c) comparing said time of emission and said image capture time.

25. The method for detecting an object of claim 23 wherein the step of determining if said image capture time coincides with a time of emission by said light source arranged to emit light in said temporally distinct pattern of emission comprises the steps of:

(a) determining a time of emission by said light source from a signal emitted by a global positioning system; and (b) determining an image capture time from said signal emitted by said global positioning system to coincide with said time of emission.

26. The method for detecting an object of claim 19 wherein said temporally distinct pattern of emission is further distinctive of an identity of said object associated with said light source.

* * * * *